United States Patent [19]

Evans

[11] Patent Number: 5,037,028

[45] Date of Patent: Aug. 6, 1991

[54] COMBINATION WATER-DIRECTING DEVICE AND METHOD

[76] Inventor: Richard D. Evans, 401 Yuba St., Vallejo, Calif. 94590

[21] Appl. No.: 507,448

[22] Filed: Apr. 11, 1990

[51] Int. Cl.[5] ..... B05B 15/06; B05B 7/30

[52] U.S. Cl. ..... 239/1; 239/10; 239/310; 239/532

[58] Field of Search ..... 239/1, 10, 532, 310, 239/289, 525, 526, 458; 134/167 C; 15/236.04; 401/137, 139, 261, 289

[56] References Cited

U.S. PATENT DOCUMENTS

| | | | |
|---|---|---|---|
| 2,889,994 | 6/1959 | French | 239/310 |
| 2,910,711 | 11/1959 | Mizelle | 239/532 |
| 3,001,725 | 9/1961 | Lockett | 239/458 |
| 4,303,348 | 12/1981 | O'Brien | 15/236.04 |
| 4,311,404 | 1/1982 | Kodera | 401/289 |
| 4,750,883 | 6/1988 | Drake | 239/532 |

FOREIGN PATENT DOCUMENTS

| | | | |
|---|---|---|---|
| 553140 | 2/1958 | Canada | 239/532 |
| 2354981 | 5/1975 | Fed. Rep. of Germany | 401/289 |
| 2105615 | 3/1983 | United Kingdom | 239/279 |

*Primary Examiner*—Andres Kashnikow
*Assistant Examiner*—Karen B. Merritt
*Attorney, Agent, or Firm*—Harold D. Messner

[57] ABSTRACT

A multi-functioning water-directing device is described comprising an input garden hose coupler, a series of straight pipe sections, an U-shaped transition pipe section, a straight output water-directing jetting segment, and a handle all coupled together by a plurality of coupling means. As a result, fluid flow can be directed both downstream and upstream relative to said handle and eventually exit from the jetting segment in a desired output pattern. In accordance with one aspect, the handle (positioned in parallel contact with at least the U-shaped transition section and the jetting segment and in series contact with at least the input hose coupler), is constructed so that its interior is placed in fluid contact with passing fluid stream wherein the weight of the contained fluid adds handling stability as the device is dynamically moved through a series of working positions such as relative to an overhead rain gutter and high riding motor vehicle. After assembly, the axes of symmetry of the following elements are coincident: the input hose coupler, the series of straight pipe sections, the U-shaped transition pipe section and the handle. As a result, a common working plane is defined through such axes whereby surprisingly flexibility of operations results. In a preferred form, the device is formed of light-weight plastic piping and associated couplers thus permitting the device to span relatively large vertical or horizontal distances. Operational and assembly steps are also described.

19 Claims, 7 Drawing Sheets

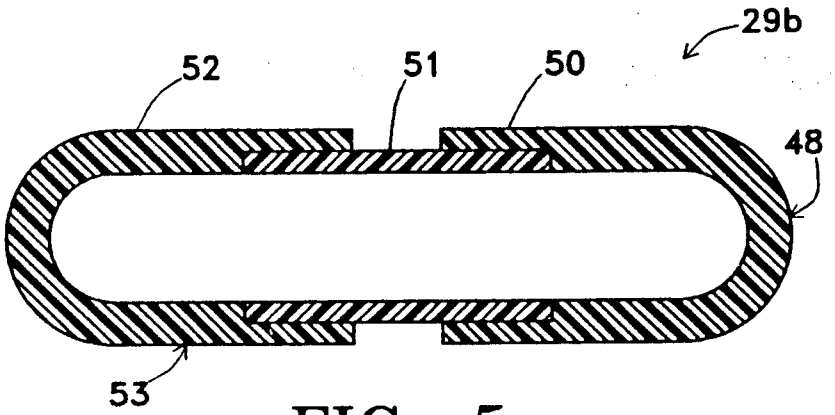
FIG. 5
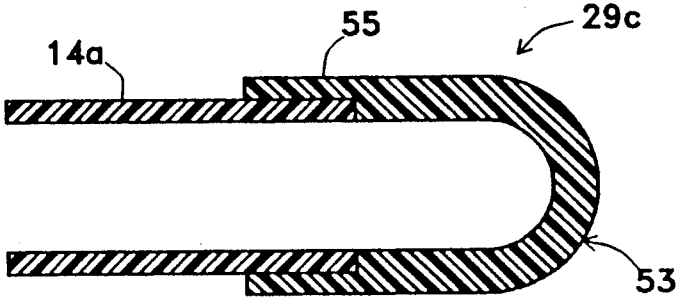
FIG. 6
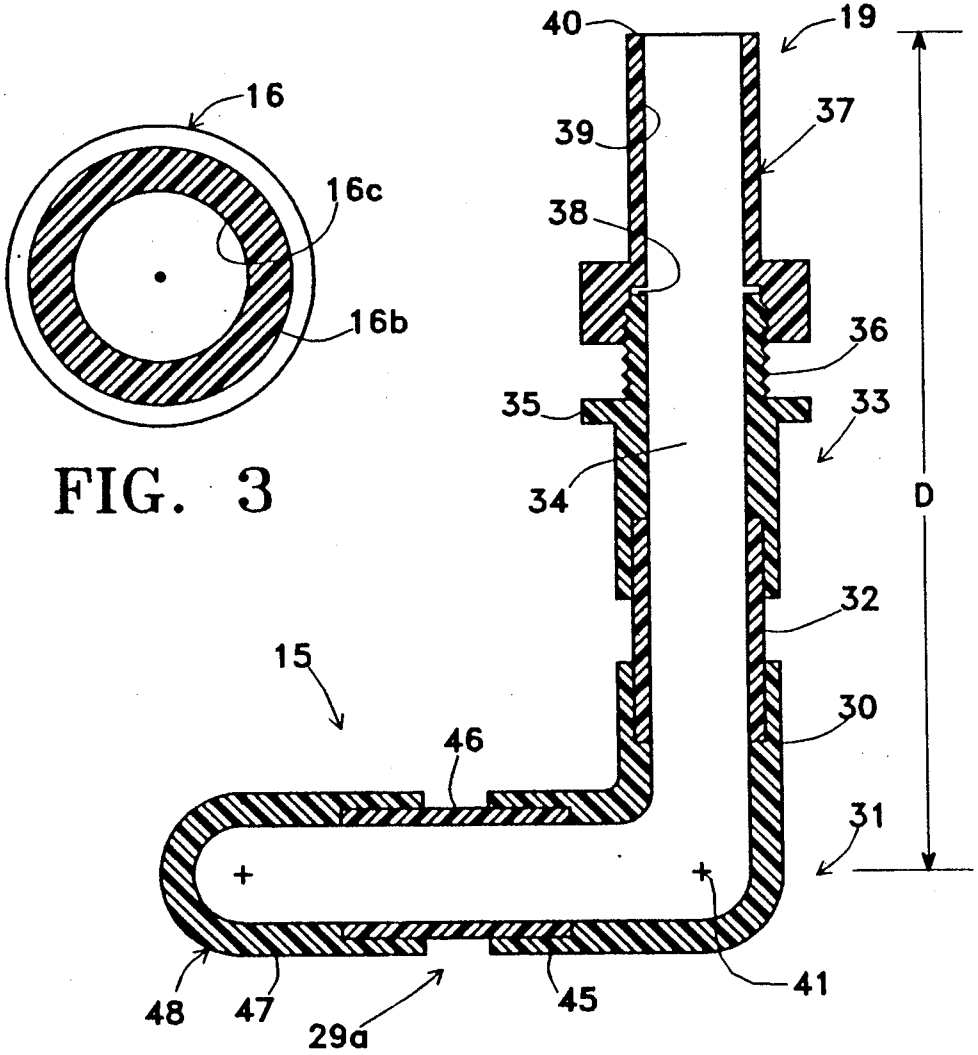
FIG. 4
FIG. 3

COMBINATION WATER-DIRECTING DEVICE AND METHOD

SCOPE OF THE INVENTION

The present invention relates to means and methods for combining the following: (i) cleaning of rain gutters of homes, apartments and the like, with either (ii) cleaning of roofs, side walls and/or cabs of multi-functional vehicles such as recreational vehicles, trucks or other types of high riding vehicles; (iii) ordinary irrigation; and (iv) chemical spraying using water soluble chemicals, viz., plant food, insecticides and herbicides. More particularly, the invention relates to means and methods of the above-described type featuring construction using, for the most part, conventional plastic piping and associated couplers manufactured of light-weight PCV plastic. Hence the present invention is light weight and can be worked by a person of ordinary height and strength, without undue strain.

BACKGROUND OF THE INVENTION

Specialized tools are believed to be available to clean rain gutters. Other types are likewise employed to clean recreational vehicles and other types of high riding vehicles. Still further, there are a multiplicity of devices for irrigating and spraying plant life around homes, apartments, office buildings and the like. An ordinary garden hose is usually employed to direct the water through such devices. At their outlets, the water emerges in a desired pattern. To clean RV's and other types of high riding vehicles, brushes can be added to loosen the dirt and grime from the roofs of high riding vehicles. Furthermore, there are a plurality of siphon sprayers also available in the marketplace for use in association with the ordinary garden hose. However, I am unaware of any tool that combines the two or more of above described functions that is inexpensive to construct, has a minimum of parts, is safe to operate yet is easily stowable.

SUMMARY OF THE INVENTION

The present invention includes means and methods that combines the above-described functions. In one aspect, a multi functioning water-directing device includes an input hose coupler attaching to an ordinary garden hose, a series of straight plastic pipe sections, an U-shaped transition pipe section and a straight output water-directing jetting segment. A handle (also formed of plastic pipe and end cap) is placed in parallel with the pipe sections. Key feature: The input hose coupler, the series of straight pipe sections, the U-shaped transition pipe section and the handle all having axes of symmetry that are coincident with a common working plane. The output water-directing jetting segment has an axis of symmetry that is normal to the aforementioned common working plane. Furthermore, these elements are formed of piping and associated plumping coupling means constructed of light-weight plastic such as PCV. As a consequence, surprisingly flexibility of operations results in that the water-directing means and method of the invention can be anchored either in a near vertical working plane or along almost horizontal working plane and used by a person of ordinary strength and stature.

In more detail, when the device of the present invention is used as a gutter cleaner, it is worked such that its common working plane always intersects the axis of symmetry of the gutter. And parallel legs of the U-shaped transition section straddle the exterior wall of the gutter. Thus, the water directing jetting segment can lay along the bottom wall of the gutter in easy sliding contact. The end of the jetting segment always points away from the working plane in a direction that is 90 degrees to the working plane.

When the garden hose is activated, water enters and exits the device as follows. The water flows first into the first pipe section downstream of the handle, thence passes into the handle adding weight for better balance and then upstream through the second and third pipe sections, thence the U-shaped transition section before exiting from the water-directing jetting segment. Debris including leaves, dirt, grime and the like are flushed along the gutter and either over its side or through the down spout. As the working plane is moved along the gutter to new working positions (in the same direction as water flow, for example), eventually the entire gutter section is freed of previously situated debris.

In this regard, the length of the pipe sections are design to permit such person to work the device in the desired pattern. For example for cleaning gutters and high riding vehicles, the series of pipe sections includes a one-foot section downstream of the handle and a 2.5 foot section, a 2 foot section and a 3.5 foot section upstream of the handle. Plastic couplers are used to interconnect the sections and the handle. Thus, a person of ordinary height, say 5 foot 10 inches, and strength, can easily operate the device from chest high position to attain a working position that is 12–14 feet above ground level. For lower work positions, the two-foot section can be omitted so that there are a 2.5 foot and a 3.5 foot section upstream of the handle. This allows work positions in a range of 10–12 feet also to be attained.

When used as a sprinkler, the device is repositioned such that the common working plane is parallel to the surface of the ground to be irrigated. The water-directing segment is thus normal to the earth's surface. In that way, when a garden hose is activated, the water flows first into the first pipe section, thence passes into the handle adding weight for better balance and then through the second . . . fourth pipe sections, thence the U-shaped transition section and out the water-directing jetting segment. The emerging water sprays upward, i.e., skyward. If desired, the water-directing jetting segment can be provided with a conventional jetting nozzle as used in conventional lawn irrigation systems, to provide a more conventional spray pattern.

When used as a chemical sprayer, the device is modified wherein the third pipe section upstream of the handle is omitted and the second pipe section is shortened so that the combined length of the upstream sections is from approximately 3½ to 4 feet. The handle is also modified to support a container for the source of chemicals. A siphon-generating subassembly is also added. In that way, plant food, herbicides, insecticides and other water soluble chemicals can be used in the patio, lawn and garden but without tainting the garden hose. That is, when a garden hose is activated the water flows first into the first pipe section then passes into the modified handle to add balance and thence into the siphon-generating subassembly upstream of the handle where a vacuum is created by the passing water in narrowed jet leg of a mixer. Then the mixed chemicals and water in solution flow through the fourth pipe section, thence the U-shaped transition section and finally out the water-directing jetting segment. The emerging water and chemical in solution are outwardly directed from the jetting segment in a direction that is normal to the working plane of the modified device. After use, clean-up is straight forward. Clean water is placed in the container while flushing water is passed via the garden hose and join together interior of the device. Note that the problem of tainting of the ordinary garden hose by chemical residue is thus avoided. Also the length of the second and fourth pipe sections upstream of the handle is design to prevent the ordinary person from drinking from the jetting segment while holding the handle. Hazard signs warning of possible toxic residue are also imprinted on the pipe sections.

The device of the present invention is then stowed. In this regard, where stow space is limited, the device can be broken down by sections and stored in a suitable container.

DESCRIPTION OF DRAWINGS

FIGS. 3, 4, 5 and 6 are sections taken along lines 3—3, 4—4, 5—5 and 6—6, respectively, of FIG. 1;

DETAILED DESCRIPTION OF AN EMBODIMENT OF THE INVENTION

Figure 1:
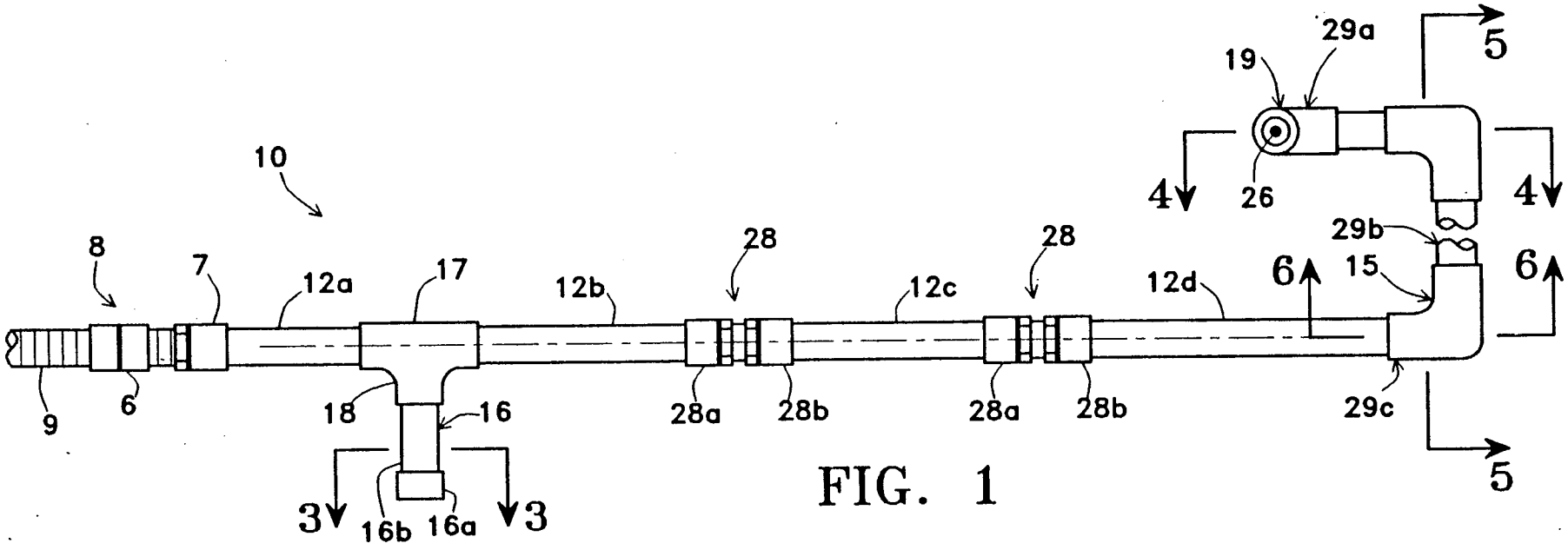
FIGS. 1 and 2 are plan and side views, respectively, of the device of present invention constructed of conventional plastic piping and coupling means such PCV.
Figure 2:
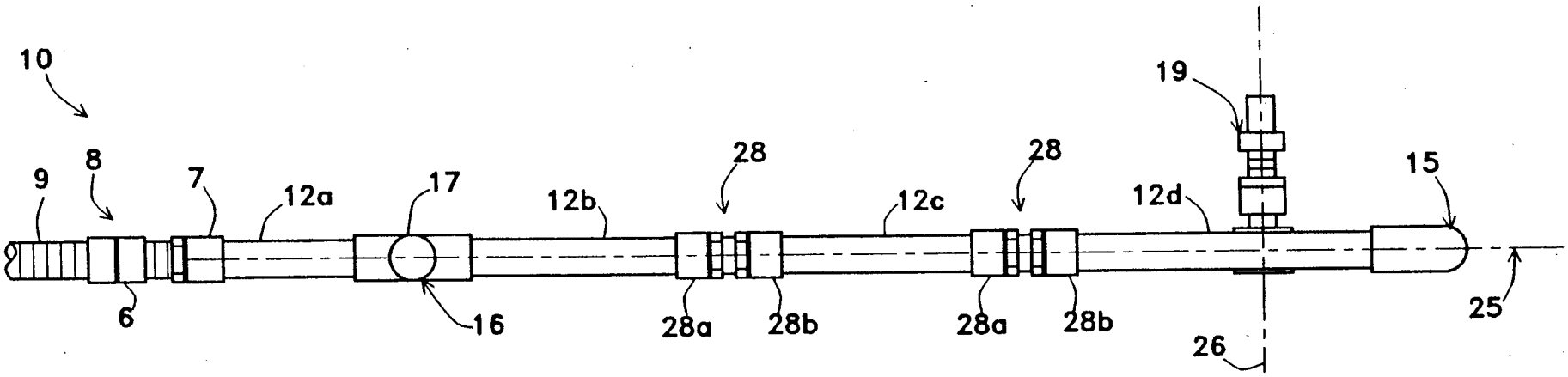

FIGS. 1 and 2 illustrate a multi-functioning water-directing device 10 of the present invention. The device 10 includes threaded input hose coupler generally indicated at 8 to permit attachment to an ordinary garden hose 9, a series of straight plastic pipe sections 12*a*, 12*b*, 12*c* and 12*d* connected between the input coupler 8 and U-shaped transition pipe section 15. Intermediate of the straight line section 12*a* and 12*b* is handle 16. The handle 16 consists of an end cap 16*a* and pipe stub 16*b* connected to Tee 17 positioned inline with the pipe sections 12*a*, 12*b*, 12*c* and 12*d*. As shown best in FIG. 3, the hollow handle 16 includes interior sidewall 16*c* of the pipe stub 16*b* in fluid contact with the interior of pipe sections 12*a*, 12*b* in order to withstand the recoil of the exiting water from water-directing jetting segment 19.

Returning to FIGS. 1 and 2, note that the jetting segment 19 is connected to the terminus of the U-shaped transition section 15. Note also that the coupler 8, the series of straight pipe sections 12*a* . . . 12*d*, the U-shaped transition pipe section 15 and the handle 16 have axes of symmetry that are coincident with a common working plane generally indicated at 25 in FIG. 2. The output water-directing jetting segment 19 has an axis of symmetry 26 that is normal to the aforementioned common working plane 25.

The straight pipe sections 12*a* . . . 12*d* have differing lengths defined by a series of couplers therealong. For example, between pipe section 12*a* and 12*b* is the Tee 17 previously mentioned (also having an arm 18 connected to pipe stub 16*b*). Between sections 12*b* and 12*c* and between sections 12*c* and 12*d* are identical male/female threaded couplers 28 each consisting of male element 28*a* and female element 28*b*. At the remote end, the U-shaped transition section 15 includes parallel legs 29*a* and 29*c* interconnected by transverse leg 29*b* with leg 29*a* connecting, in turn, to water-directing jetting segment 19.

FIGS. 4, 5 and 6 illustrate U-shaped transition section 15 and jetting segment 19 in more detail.

As shown in FIG. 4, the jetting segment 19 includes an arm 30 of an elbow 31 attached to a pipe stub 32. At the other end, the stub 32 attaches to male coupler 33. The male coupler 33 has a cavity 34 at its interior, projections 35 at its outer circumference (to accommodate a wrench) and terminates in threaded portion 36 engaged to nozzle 37. Nozzle 37 has a cavity 38 to mate with threaded portion 36 of the male coupler 33, continuous radial extensions 38 and an interior passageway 39 terminating at end 40. The distance from end 40 to center 41 of the elbow 31 is equal to D where D is about 5 to 6 inches.

Also shown in FIG. 4 is the first parallel leg of the U shaped transition section 15, such leg being indicated at 29*a* and including the following: second arm 45 of the elbow 31 previously described in relation to the jetting segment 19, pipe stub 46 and arm 47 of elbow 48. The arms 45 and 47 are interconnected by the pipe stub 46.

As shown in FIGS. 5 and 6, the remaining legs 29*b* and 29*c* of the U-shaped transition section 15 also include the following, respectively: The leg 29*b* includes second arm 50 of the elbow 48 previously described, pipe stub 51 and arm 52 of elbow 53. The arms 50 and 52 are interconnected by pipe stub 51.

Finally, the third leg 29*c* of the U-shaped transition section 15 includes second arm 55 of the elbow 53 described above and a portion of the straight pipe section 12*d* indicated at 13.

Figure 7:
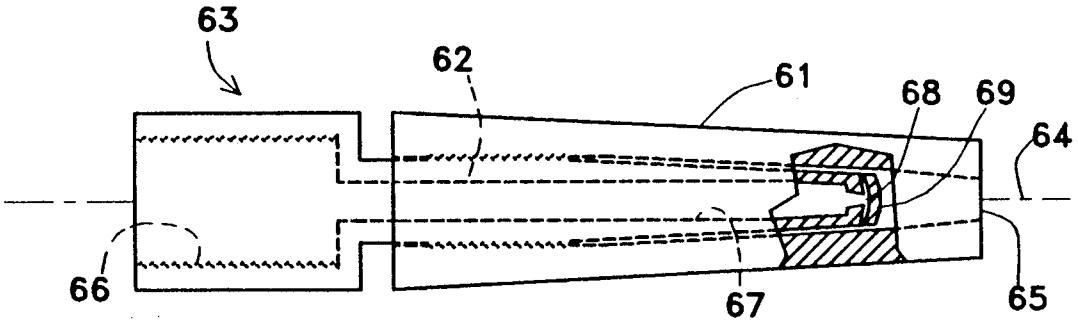
FIG. 7 is a side view of a metallic nozzle having an inside diameter that can emit a more narrow stray of water.

Returning to FIG. 4, if desired, the nozzle 37 of the jetting segment 19 there shown, can be substituted for, say using a conventional rotatable metallic nozzle 60 pictured in FIG. 7 for attachment to threaded portion 36 of the male coupler 33 of the jetting segment 19 of FIG. 4. Since the threaded portion 36 is a standard pipe thread which is different than that of a conventional garden hose usually attached interior of the nozzle 60, a short nipple (not shown) having correctly associated threads at its end sections can be used to bridge the parts. While more expensive, nozzle 60 has the added advantage of outer cylinder 61 that is threadably attached about barrel 62 of inlet cylinder 63 and can be rotated and moved along the axis of symmetry 64 of the nozzle 60 to effect flow at exit 65. That is to say, water entering cavity 66 of the inlet cylinder 63 is directed through bore 67 of the barrel 62, then pass via openings 68 and thence into cavity 69 of the outer cylinder 61 and out exit 65.

Returning to FIGS. 1 and 2, note that the hose coupler 8 attaches between male pipe fitting 7 and garden hose 9 and includes independently rotatable female-to-female coupler 6.

Figure 8:
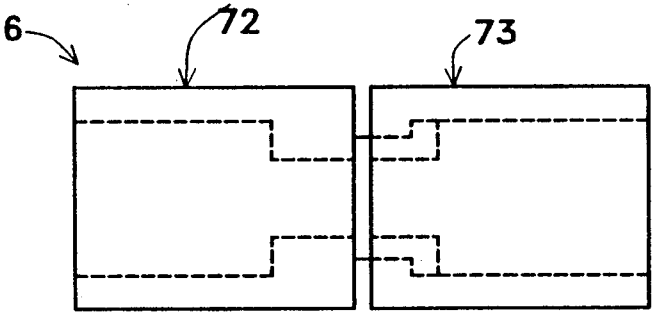
FIGS. 8 and 9 are detailed side and end views of a flexible coupler that can be used with the device of FIGS. 1-2 to assure that proper relationship between elements thereof are achieved.
Figure 10:
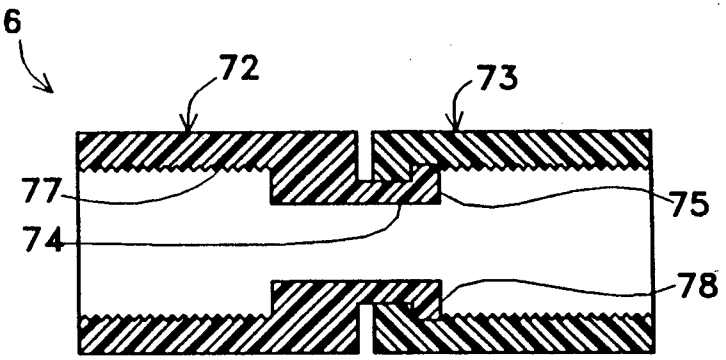
FIG. 10 is a section taken along line 10—10 of FIG. 9.
Figure 9:
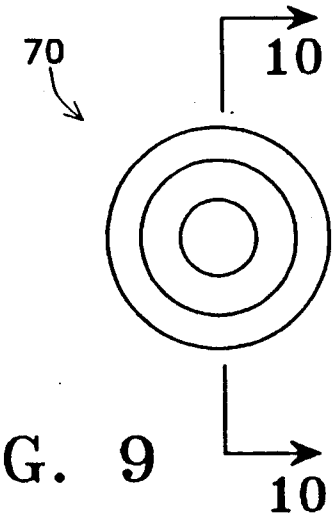

FIGS. 8, 9 and 10 illustrate female-to-female coupler 6 in more detail.

As shown, coupler 6 includes independently rotatable female members 72 and 73. The female member 72 includes a central projection 74 having an upturned lip 75 about which the remaining female member 72 is rotatable. Threaded cavities 77 and 78 of the female members 72, 73, respectively, complete the coupler 70. The threads of cavity 77 are a standard number per inch used in pipe applications while the number of threads per inch of cavity 78 are matched to those of a convention garden hose.

METHOD ASPECTS

There are several applications that the device 10 of the present invention can be used by a person of ordinary strength to provide a desirable work pattern.

Figure 11:
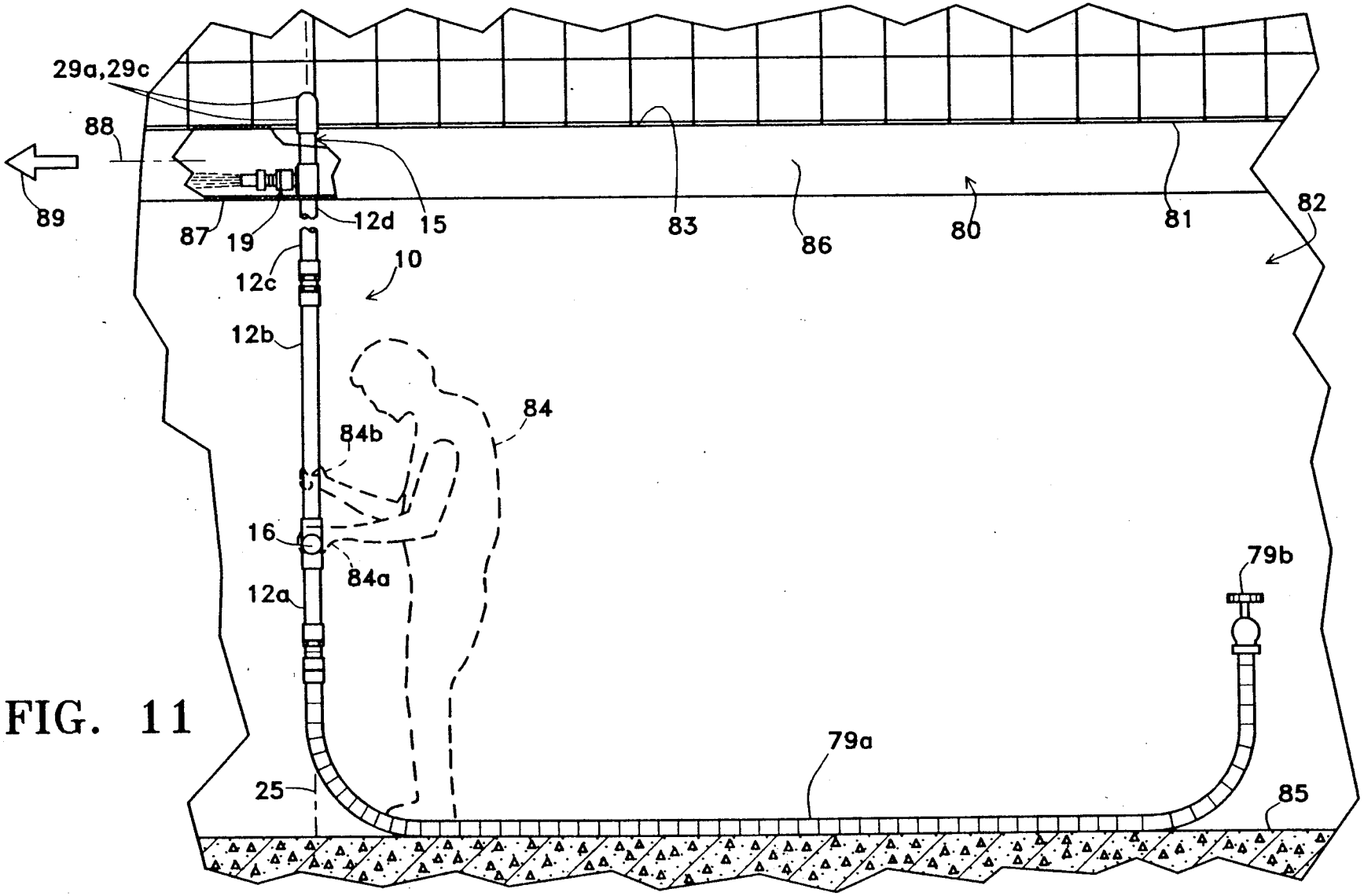
FIG. 11 is a side view of the device of the present invention in use in a gutter cleaning mode wherein the gutter is cut-away to show the water-directing jetting segment in more detail.

For example, as shown in FIG. 11, gutter 80 attached to eves 81 of a home 82, can be cleaned by a person 84 of ordinary strength and height. In this regard, the person 84 first elevated the device 10 of the invention to place the U-shaped transition section 15 above lip 83 of outer wall 86 of the gutter 80. Legs 29*a* and 29*c* of the section 15 thus straddle the gutter wall 86. The water directing segment 19 is placed in contact with bottom gutter wall 87. Note that if the person 84 is right-handed, his left hand 84*a* is in lifting contact with handle 16 and right hand 84*b* in guiding contact with pipe section 12*b* upstream from the handle 16. Note in this regard that section 12*c* can be omitted. In such case, the section 12*d* would connect directly to section 12*b*. In such an embodiment of the invention, the pipe sections 12*b* and 12*d* above handle 16 would be approximately 6 feet in length while section 12*a* is one foot in length. Thus, even a person of ordinary height, say 5 foot 10 inches, can easily operate the embodiment of the invention from chest high position to clean the gutter 80 even though the latter is 10–12 feet above concrete patio 85.

For a gutter 80 that may be higher, the person 84 must re-introduce the section 12*c*, allowing a gutter 80 in a height range of 12–14 feet above patio 85 to be cleaned. Note that in cleaning of the gutter 80 that the working plane 25 (previously described in FIGS. 1 and 2) always intersects the axis of symmetry 88 of the gutter 80 and is held in a substantially vertical working position. That is to say, when either embodiment of the invention is used as a gutter cleaner, the common working plane 25 of the device 10 is substantially normal to the gutter axis of symmetry 88. Since the parallel legs 29*a* and 29*c* of the U-shaped transition section 15 straddle the exterior gutter wall 86, the water-directing jetting segment 19 points away from the working plane 25 in a direction 89 that is 90 degrees to the working plane 25. With garden hose 79*a* activated via tap 79*b*, water enters and exits the device 10 as follows. The water flows first into pipe section 12*a* downstream of the handle 16, thence passes into the handle 16 adding weight for better balance and then upstream through the straight pipe sections 12*b*, 12*c* and 12*d* thence into the U-shaped transition section 15 and out the water-directing jetting segment 19. Debris including leaves, dirt, grime and the like within the gutter 80 are flushed in direction 89 and either exits over wall 86 or through a down spout (not shown). As the working plane 25 is moved in the direction 89, new working positions are defined along the gutter 80 and the process is repeated. Eventually the entire length of gutter 80 is freed of previously situated debris. For cleaning high riding vehicles such as recreational vehicle 90 of FIG. 12, the device 10 is held in a more horizontal position relative to surface 91 of the earth 92. In this regard, person 93 elevates the device 10 to a position such that the U-shaped transition section 15 and jetting segment 19 are positioned adjacent to roof 94 of the vehicle 90. That is, the water directing segment 19 is pointed in directly impact the water upon the roof 94. Note that if the person 93 is right handed, his left hand 93*a* is still in lifting contact with handle 16 and right hand 93*b* is in guiding contact with pipe section 12*b* upstream from the handle 16. In operation with garden hose 95 attached and water passing therethrough, water enters and exits the device 10 as follows. The water flows first up the inclined straight pipe section 12*a* passing into the handle 16 adding weight for better balance, through pipe sections 12*b*, 12*c* and 12*d*, thence into the U-shaped transition section 15 and out the water-directing jetting segment 19 onto the roof 94. Dirt, grime and the like on the roof 94 are driven away from the vehicle 90. As the working plane 25 is moved about the vehicle 90, new working positions are defined and the process is repeated. Eventually the entire vehicle 90 is freed of previously situated dirt and grime.

Figure 13:
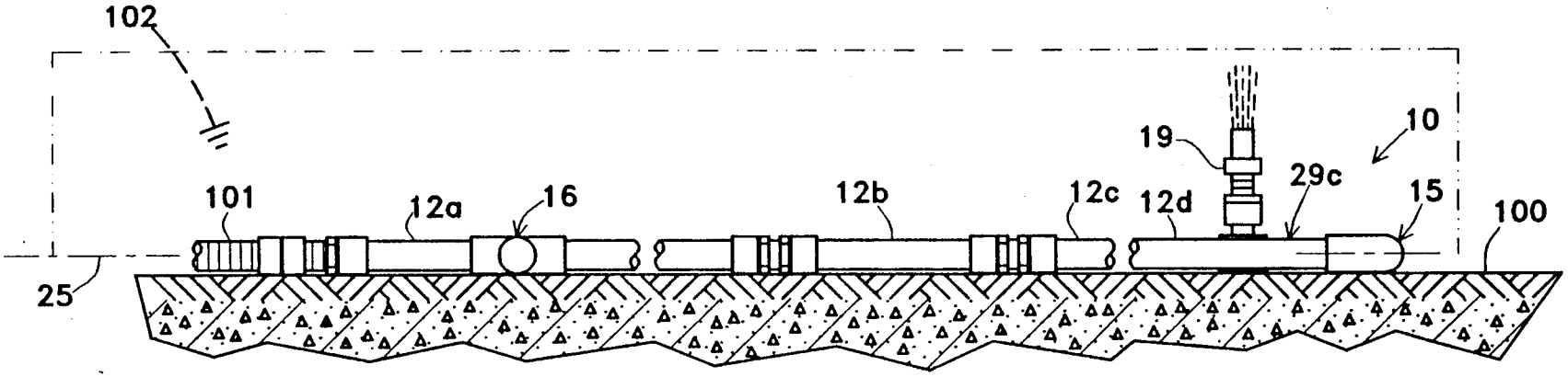
FIG. 13 is a side view of the device in use in a irrigation mode.

When used as a sprinkler as shown in FIG. 13, the device 10 is first placed in a horizontal position upon earth's surface 100. In operation with garden hose 101 attached and water passing therethrough, water enters and exits the device 10 as follows. The water flows first into the device 10 in a direction that is parallel to the earth's surface 100. I.e., the water passes through the pipe section 12*a* and the handle 16 (at the handle 16, weight is added to withstand the recoil of the exiting water) and thence through the pipe sections 12*b*. . . 12*d* into the U-shaped transition section 15 and out the water-directing jetting segment 19 in a spray pattern. Note that the common working plane 25 is parallel to the earth's surface 100 while a vertical plane 102 is normal thereto but coincident therewith. In this way, the vertical plane 102 permits the handle 16 to be offset on one side and the U-shaped transition section 15 (except for third leg 29*c*) and jetting segment 19 to be offset on the other side, for better stability. The water-directing segment 19 is also normal to the working plane 25. As the area under the spray is sufficiently irrigated, new working positions are provided and the process is repeated.

Figure 12:
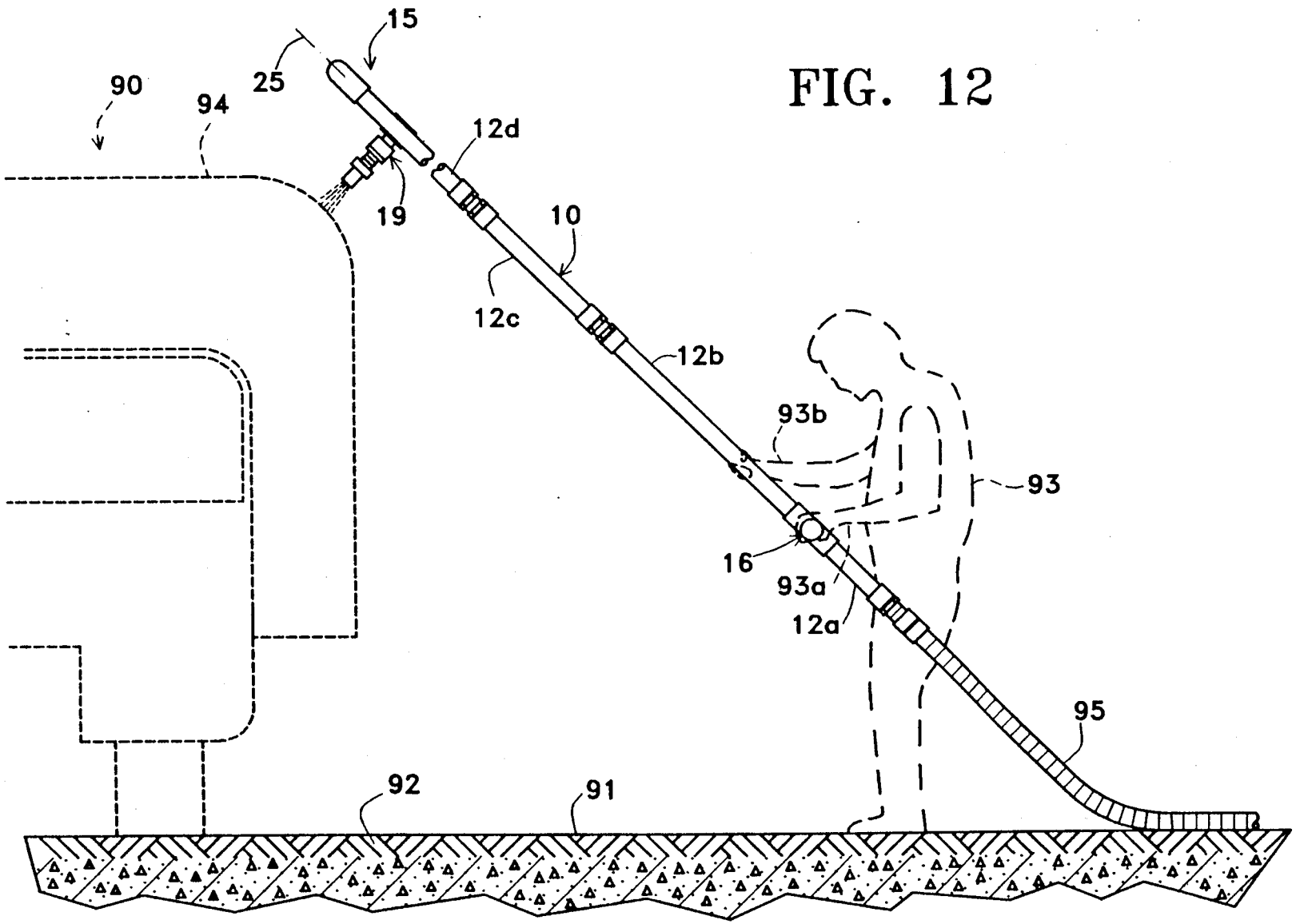
FIG. 12 is a side view of the device in use in cleaning a high-wheeled or riding vehicle.

In the uses set forth above in association with FIGS. 11, 12 and 13, it may be desirable to vary the rate and pattern of discharge from jetting segment 19. As previously indicated, this can be easily achieved by using nozzle 60 of FIG. 7. In addition since the device 10 of the present invention can be constructed of piping and associated couplers and fittings used in conventional plastic plumbing applications, it is preferable that they be manufactured of light-weight PCV plastic. Hence the device 10 is light enough for the ordinary person to work the latter above his head without strain, if needed.

Figure 14:
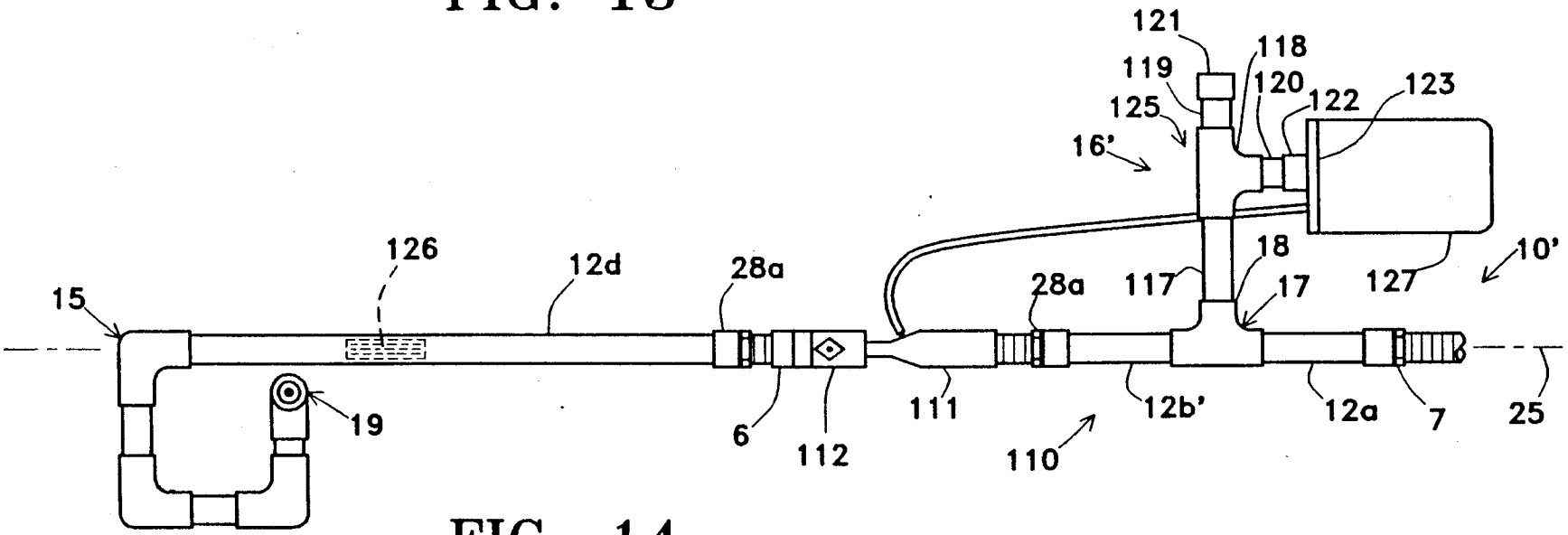
FIG. 14 is a side view of the device modified to include a siphon-generating subassembly for use in a spraying mode.

When used as a chemical sprayer, there are a few significant changes to create another embodiment indicated at 10' as shown in FIG. 14. As shown the modified device 10' of the invention is first shorten wherein the length of the upstream section 12b'; section 12c is omitted; handle 16' is modified; and a siphon-generating subassembly 110 is added. In that way, plant food, herbicides, insecticides and other water soluble chemicals can be used in the patio, lawn and garden but without tainting the garden hose. However, the length of the length of the pipe section 12d, subassembly 110 and pipe section 12b' is designed to prevent the ordinary person from drinking from the jetting segment 19 while holding the modified handle 16'. In addition, a placard generally indicated at 126 is attached to the pipe section 12d to warn of the possibility.

As indicated, the device 10' includes siphon-generating subassembly 110. The subassembly 110 is connected (via male element 28a) to shortened pipe section 12b'. Note that subassembly 110 includes a mixer 111 and the latter is attached inline to U-shaped transition section 15 and jetting segment 19 through the following parts: via garden hose ball valve 112, female/female coupler 6, male element 28a, and pipe section 12d. In this regard, the axes of symmetry of the male pipe fitting 7, the pipe sections 12b', the pipe section 12d, mixer 111, hose ball valve 112, coupler 6 and male elements 28a are coincident with working plane 25. Jetting segment 19, of course, remains normal to the working plane 25. At the other end of the subassembly 110, the mixer 111 attaches to the male pipe fitting 7 via shortened pipe section 12b', inline Tee 17 and pipe section 12a. The modified handle 16' also attaches to the inline Tee 17, at arm 18. The modified handle 16' also includes pipe stub 117, balancing Tee 118, terminating pipe stubs 119 and 120 and end caps 121 and 122 forming a support means generally indicated at 125 for container 127. The pipe stub 117 connects between the inline Tee 17 and the balancing Tee 118, while the stubs 119 and 120 terminate in the caps 121, 122, respectively. Hence water may enter into the modified handle 16' but cannot escape. At the broad surface of the cap 122 is an enlarged lid 123 having interior threads attached to container 127 into which the plant food, herbicides, insecticides and other water soluble chemicals are placed.

Figure 16:
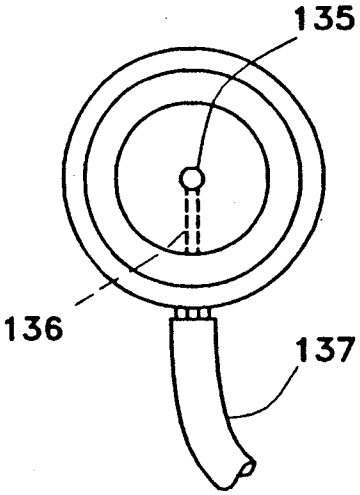
FIGS. 15 and 16 are detail plan and end views of the mixer of the siphon-generating subassembly of FIG. 14.
Figure 17:
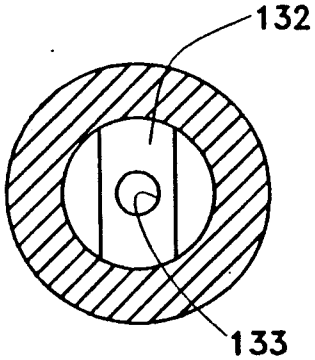
FIG. 17 is a section taken along line 17—17 of FIG. 16.
Figure 15:
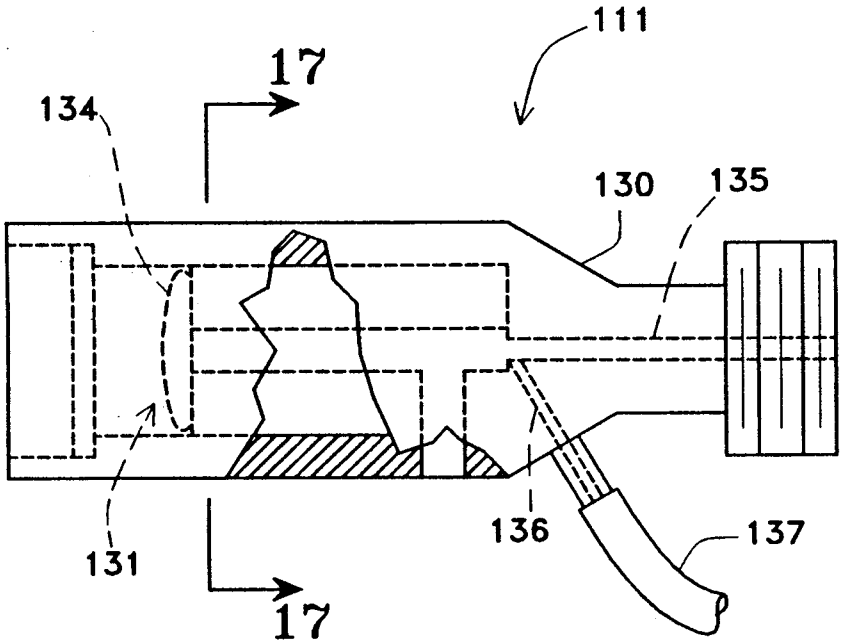

FIGS. 15, 16 and 17 illustrate the mixer 111 in more detail,

As shown, the mixer 111 includes a cylindrical housing 130, and a backflow preventor 131 consisting of by-passing plastic insert 132 having a central opening 133 shielded by a movable rubber stopper 134. Upstream of the backflow preventor 131 is a narrowed jetting leg 135. Positioned at the entrance of the jetting leg 135 is radial opening 136 connected through a dribble hose 137 to the container 127 of FIG. 14.

In operation, when a garden hose is attached as previously explained, assume the ball valve 112 is closed but the correct amount of chemicals have been stowed in the container 127. The device 10' is then positioned adjacent to a plant to be sprayed and the ball valve 112 is opened. The water then passes through mixer 111 where a vacuum is created by the passing water in its narrowed jet leg 135. Such vacuum is based on an application of Bernoulli's principle of fluid flow. Then the mixed chemicals and water in solution eventually pass through the hose straight pipe section 12d, the U-shaped transition section 15 and out the water-directing coupler segment 19. The emerging water and chemical in solution sprays outward.

After use, clean-up is straight forward. Clean water is placed in the container 125 while flushing water is passed via the garden hose through the device 10'. The water from the container 125 is thus used to flush the dribble hose 137 and radial opening 136 as well as the jet leg 135 and joins with the main flushing stream interior of the device 10'. Note that the problem of tainting of the ordinary garden hose by chemical residue is thus avoided.

The device 10, 10' of the present invention is then stowed. In this regard, where stow space is limited, the device 10, 10' can be broken down into equi-length sections and stored in a suitable container.

Having described the present invention, the advantages can be appreciated. It should be also understood that the invention is not limited to embodiments described hereinbefore as many variations will be readily apparent to those persons skilled in the art. For example, during assembly, so assure that correct relationship between the pipe sections 12a. . . 12d, handle 16, 16' and the jetting segment 19 occurs, there may be a need to use a pipe wrench to snug the couplers, pipe sections and fittings in correct relationship without allowing leakage. Plumbers putty can also be used. Thus, the invention is to be given the broadest possible interpretation with the terms of the following claims.

What is claimed is:

1. A multi-functioning water-directing device for cleaning debris from a gutter or high riding motor vehicle from a series of working positions quickly and efficiently comprising an input garden hose coupler, a series of straight pipe sections, an U-shaped transition pipe section, a straight output water-directing jetting segment, and a handle all coupled together by a plurality of coupling means to direct fluid flow both downstream and upstream relative to said handle and out said jetting segment under pressure to flush loose debris from one of a gutter and high riding motor vehicle positioned above and adjacent an operator, said series of straight pipe sections, said U-shaped transition pipe section, said straight output water-directing jetting segment, said handle and said plurality of coupling means being formed of light weight plastic whereby an operator of ordinary strength and height provides dynamic, rectilinear movement thereof relative to said one of said gutter and said high riding motor vehicle in a series of different working positions, said series of pipe sections comprising at least first and second pipe sections serially connected to each other to permit relatively large vertical or horizontal distances to be spanned, said handle being in parallel fluid contact with said second pipe section but in series contact with said first pipe section wherein axes of symmetry of said input hose coupler, said series of straight pipe sections, said U-shaped transition pipe section and said handle are substantially coincident and define a common working plane as said series of different working positions are sequentially attained relative to said one of said gutter and high riding motor vehicle, and wherein the weight of the contained fluid herein during operations increases the capability of said operator to withstand the recoil of the exiting water from said jetting segment normal to said common working plane and aids in said rectilinear movement relative to said one of said gutter and high riding motor vehicle, as said working positions are sequentially attained.

2. The device of claim 1 wherein said light-weight plastic is polychlorinated vinyl (PCV).

3. The device of claim 1 in which said jetting segment is positioned with said gutter at height between 10–12 feet above ground level.

4. The device of claim 1 wherein said U-shaped transition section includes first and second parallel legs that straddle an exterior wall of said gutter and a third leg connecting said first and second legs positioned above said exterior gutter wall.

5. The device of claim 4 in which said jetting segment is in slidable contact with a bottom wall of said gutter, said jetting segment having an end pointing away from said working plane in a direction that is 90 degrees thereto.

6. A multi-functioning water-directing device comprising input garden hose coupler, a series of straight pipe sections, an U-shaped transition pipe section, a straight output water-directing jetting segment, and a handle all coupled together by a plurality of coupling means to direct fluid flow both downstream and upstream relative to said handle and out said jetting segment, said handle being in parallel contact with at least said U-shaped transition section and said jetting segment, said handle also being in series contact with at least said input hose coupler wherein axes of symmetry of said input hose coupler, said series of straight pipe sections, said U-shaped transition pipe section and said handle are substantially coincident and define a common working plane, said output water-directing jetting segment having an axis of symmetry normal to said common working plane whereby surprisingly flexibility of operations results wherein near vertical and almost horizontal working positions can be easily attained by a human operator.

said series of straight pipe sections, said U-shaped transition pipe section, said straight output water-directing jetting segment, said handle and said plurality of coupling means being formed of light weight plastic whereby said operator easily provides dynamic, rectilinear movement thereof through a series of working positions without undue effort, said series of pipe sections comprise at least first, second and third pipe sections serially connected to each other to permit relatively large vertical or horizontal distances to be spanned, said handle being in parallel fluid contact with said second and third pipe sections but in series contact with said first pipe section wherein the weight of the contained fluid herein during operations increases the capability to withstand the recoil of the exiting water.

a siphon-generating subassembly upstream of the handle between said second and third straight pipe sections, said subassembly including an inline chemical mixer having a backflow preventor, a narrowed interior jetting leg upstream of the backflow preventor fitted with a opening connected through a dribble hose to a source of chemicals to be sprayed.

7. The device of claim 6 with the addition of support means attached to said handle and including a central Tee coupler having a third arm, a pipe stub and an end cap, said pipe stub being connected between said third arm and said end cap, said end cap being connected to a lid of a source container for water soluble chemicals to be sprayed.

8. The device of claim 6 in which more intermediate working planes are attained to easily permit spraying of plant food, insecticides, herbicides and the like water-soluble chemicals from said jetting segment.

9. A method of cleaning debris from a rain gutter of a home, apartment or the like using a multi-functioning water-directing device comprising an input hose coupler for attachment to an ordinary garden hose, a series of straight pipe sections, an U-shaped transition pipe section, a straight output water-directing jetting segment, and a handle, said handle being connected to said series of straight pipe sections, said U-shaped transition section and said jetting segment wherein axes of symmetry are substantially coincident and define a common working plane, said output water-directing jetting segment having an axis of symmetry normal to the aforementioned common working plane whereby surprisingly flexibility of operations results in that near vertical working positions can be easily attained by an operator of ordinary strength and height, said series of straight pipe sections, said U-shaped transition pipe section, said straight output water-directing jetting segment, said handle and said plurality of coupling means being formed of light weight plastic, said series of pipe sections comprising at least first and second pipe sections serially connected to each other to permit relatively large vertical or horizontal distances to be spanned, said handle being in parallel fluid contact with said second pipe section but in series contact with said first pipe section wherein axes of symmetry of said input hose coupler, said series of straight pipe sections, said U-shaped transition pipe section and said handle are substantially coincident and define a common working plane as said operator provides dynamic, rectilinear movement thereof relative to said gutter to attain a series of working positions relative to said gutter and wherein the weight of the contained fluid herein during operations increases the capability of said operator to withstand the recoil of the exiting water from said jetting segment as said series of working positions are sequentially attained, comprising the steps of:

(i) elevating said device to a almost vertical working position wherein said U-shaped transition section has first and second legs that straddle an exterior wall of said gutter and a third leg connecting said first and second legs positioned above said exterior gutter wall, (ii) placing the jetting segment in fluid contact with said U-shaped transition section and in slidable contact with a bottom wall of the gutter, said jetting segment having a fluid directing end pointing away from the common working plane in a direction that is 90 degrees thereto, (iii) permitting water to exit from said fluid-directing end of the jetting segment after entry through the hose coupler, flowing first into the one of pipe sections and thence into the handle thereby adding weight to withstand the recoil of the exiting water and then upstream through the remainder of the straight pipe sections, the U-shaped transition section before exiting from the water-directing jetting segment along the gutter wherein debris including leaves, dirt, grime and the like are flushed along and away from the gutter, (iv) rectilinearly moving said device to a new working position relative to said gutter wherein the weight of the contained fluid within said handle increases the capability of said operator to withstand the recoil of the exiting water from said jetting segment and aids in said rectilinear movement relative to said gutter.

10. The method of claim 9 with the additional step of periodically moving to additional new work positions along the gutter while keeping the common working plane substantially vertical wherein the weight of the contained fluid within said handle increases the capability of said operator to withstand the recoil of the exiting water from said jetting segment and aids in said rectilinear movement relative to said gutter so as to permit the entire gutter section is freed of previously situated debris.

11. The method of claim 9 with the still further step of disconnecting the series of straight piping sections at an appropriate coupler wherein about equi-lengths result and stowing the resulting pipe sections.

12. A method of spraying plant life with a water-soluble chemicals including but not limited to plant food, insecticides and herbicides without tainting an associated ordinary garden hose using a multi-functioning water-directing device comprising an input hose coupler for attachment to the ordinary garden hose, a series of straight pipe sections, an U-shaped transition pipe section, a straight output water-directing jetting segment and a handle, said handle being connected to said series of straight pipe sections, said U-shaped transition section and said jetting segment wherein axes of symmetry are substantially coincident and define a common working plane, said output water-directing jetting segment having an axis of symmetry normal to the aforementioned common working plane whereby surprisingly flexibility of operations results in that near vertical and almost horizontal working planes can be easily attained as a series of working positions are provided by an operator of ordinary strength and height, said series of straight pipe sections, said U-shaped transition pipe section, said straight output water-directing jetting segment, said handle and said plurality of coupling means being formed of light weight plastic, said series of pipe sections comprising at least first and second pipe sections serially connected to each other to permit relatively large vertical or horizontal distances to be spanned, said handle being in parallel fluid contact with said second pipe section but in series contact with said first pipe section wherein axes of symmetry of said input hose coupler, said series of straight pipe sections, said U-shaped transition pipe section and said handle are substantially coincident and define a common working plane as said operator provides dynamic, rectilinear movement thereof relative to said plant life to be sprayed to attain a series of working positions relative thereto, and wherein the weight of the contained fluid herein during operations increases the capability of said operator to withstand the recoil of the exiting water from said jetting segment and aids in said rectilinear movement relative to said plant life as said working positions are sequentially attained, comprising the steps of:

(i) modifying the above-described device by adding a siphon-generating subassembly in series with said pipe sections;

(ii) placing the device of step (i) in a position wherein said U-shaped transition section and said jetting segment are oriented such that the common working plane is positioned between horizontal and vertical working positions whereby the fluid directing end of the jetting segment points toward the plant life to be sprayed at an spray angle that is 90 degrees to the working plane of the device;

(iii) permitting water to exit from said end of the jetting segment away from the working plane of the device without tainting the garden hose attached to the device, the water exiting from the jetting segment after flowing first into one of the series of straight pipe sections downstream of the handle, thence passing into the handle thereby adding weight thereto to better withstand the recoil of the exiting water, then upstream through the siphon-generating subassembly wherein the passing water creates a vacuum within a dribble tube interconnecting a source of water-soluble chemicals within a container and mixes with such chemicals, such mixed stream then passing through the remainder of the straight pipe sections, the U-shaped transition section before exiting from the water-directing jetting segment onto the plant life to be sprayed, (iv) rectilinearly moving said device to a new working position relative to said plant life to be sprayed wherein the weight of the contained fluid within said handle increases the capability of said operator to withstand the recoil of the exiting water from said jetting segment and aids in said rectilinear movement relative to said plant life.

13. The method of claim 12 in which step (i) includes substeps of shortening at least one of the three straight pipe sections upstream of the handle; adding support means in said handle to be attached to the container that is the source of the chemicals to be sprayed and inserting the siphon-generating subassembly upstream of the handle and support means between the second and third straight pipe sections.

14. The method of claim 13 in which even though the piping sections immediately upstream of the handle is shorten, the entire length of such piping section is designed to prevent the ordinary person from drinking from the jetting segment while holding the device by the modified handle.

15. The method of claim 14 with the addition step of affixing at least one sign to said device warning of possible toxic residue therein.

16. The method of claim 12 in which said assembly of said subassembly includes placing an inline chemical mixer between the second and third pipe sections, said mixer having cylindrical housing, a backflow preventor, a narrowed interior jetting leg upstream of the backflow preventor fitted with a opening and a dribble hose connected between the opening and the source of chemicals to be sprayed.

17. The method of claim 16 with the additional step of cleaning up the device by placing clean water in the container while passing water through the device wherein the clean water originally in the source container is thus used to flush the dribble hose and any interconnecting openings and joins with the main flushing stream interior of the device.

18. The method of claim 17 in which the back flow preventor includes substeps of subassembly of: placing a by-passing plastic insert interior of the cylindrical housing having an internal L shaped opening, the near interior leg being shielded by a movable rubber stopper during normal operation and being open when water pressure fails so as to place the near interior leg in fluid contact with a far leg that terminates exterior of the cylindrical housing to permit flushing of the mixed stream from line and prevent tainting of the water source downstream of the back flow preventor.

19. The method of claim 12 with the still further step of disconnecting the series of straight piping sections at an appropriate coupler wherein about equi-lengths result and stowing the resulting pipe sections.

* * * * *